US006692175B2

(12) United States Patent
Trump

(10) Patent No.: US 6,692,175 B2
(45) Date of Patent: Feb. 17, 2004

(54) INSERTING PAGE DEVICE

(76) Inventor: Jenny Lee Trump, 7102 S. Robb St., Littleton, CO (US) 80127

( * ) Notice: Subject to any disclaimer, the term of this patent is extended or adjusted under 35 U.S.C. 154(b) by 0 days.

(21) Appl. No.: 09/870,904

(22) Filed: May 31, 2001

(65) Prior Publication Data

US 2002/0180204 A1 Dec. 5, 2002

(51) Int. Cl.[7] ..... B42F 13/00

(52) U.S. Cl. ..... 402/73; 248/6; 248/95; 248/99; 248/100; 383/390; 141/10; 141/113; 141/114; 141/116; 141/390; 141/391

(58) Field of Search ..... 402/73; 248/95, 248/99, 100, 6; 383/390; 141/113, 114, 116, 10, 390, 391

(56) References Cited

U.S. PATENT DOCUMENTS 4,681,472 A * 7/1987 Ruble ..... 402/3
4,892,333 A * 1/1990 Krulich ..... 281/15.1
5,772,349 A * 6/1998 Tubergen ..... 402/79
6,019,540 A * 2/2000 Senior ..... 402/81
6,189,841 B1 * 2/2001 LaPoint et al. ..... 248/99
6,267,412 B1 * 7/2001 Henderson ..... 281/15.1
6,296,112 B1 * 10/2001 Pettey ..... 206/232

OTHER PUBLICATIONS www.creativeexpress.com/scrapbook/ccother.htm (copyright 1999) "Putting Page Protector Over Decorated Pages" by Kimber Fay.*

* cited by examiner

*Primary Examiner*—A. L. Wellington
*Assistant Examiner*—Mark Henderson

(57) ABSTRACT

A thin, flat device (10) for inserting scrapbook page device (22) for quick application of article protectors (20). The device is made of a flexible material, with a spine (12) so it can be repeatedly folded, without fracturing, tearing or cracking. In addition it provides a fast, easy and hassles free approach to applying article protectors (20). Not only does it provide a quick method of inserting it also protects a scrapbook page (22) from being torn, folded, bent or torn during the application of article protectors (20).

2 Claims, 2 Drawing Sheets

INSERTING PAGE DEVICE

CROSS-REFERENCE TO RELATED APPLICATIONS

The prior art shows a device that is used to improve the ability to insert paper into sheet protectors. U.S. Pat. No. 6,189,84, is an apparatus that is used to insert paper into sheet protectors by way of creating a scoop type opening starting from the top and continuing down into the sheet protector. The paper then slides down one side of the apparatus by form of a scoop. The apparatus is then pulled out of the sheet protector by padded finger holes. In recent years, activities such as scrapbooking have increasingly involved the use of sheet protectors or article protectors to protect articles from being folded, touched, bent or otherwise intentionally or unintentionally defaced or injured. These sheet protectors are produced from various materials in many shapes and sizes some purchased to fit into three ring binders, some sized specifically to fit a photograph or fill sized sheet of paper. Common to the use of many of the sheet protectors, however are several difficulties. First due to their plastic construction, which can be a thin film or heavy durable plastic, they can be very fragile and difficult to slide an article into.

PROBLEM WITH PRIOR ART

The article, which is being inserted into article protectors is still exposed on one side, therefore risking wrinkling, bending, and getting stuck upon insertion. An article can be very detailed, with photos, die cuts, stickers which are all taped, mounted or glued on a page. The prior art will not work with side loading article protectors, which slides on much like a sleeve with two open ends. When applying side loading article protectors a device is needed to be able to enter in one side and be able to be pulled out of the other side. The prior art does not address this issue and can not function in this manner due to the padded finger holes. The prior art, due to its bending also puts additional stress on the seams of article protectors. This additional stress placed on article protectors will cause them to tear. Article protectors for scrapbooking can be very fragile and need special care. The prior art also does not address the issue of a two sided article. The prior art would be unable to protect a two sided article while applying article protector. The prior art is unable to work with strap hinged pages such as created by Creative Memories®, and Westrim®, due to its design.

STATEMENT REGARDING FEDERALLY SPONSORED RESEARCH OR DEVELOPMENT

Not Applicable

REFERENCE TO A MICROFISCH APPENDIX

Not Applicable

BACKGROUND OF THE INVENTION

This invention relates to inserting devices, specifically to slipping articles, pages, papers, artwork, articles, photos inside of article protectors, photo sleeves, albums and view binders. This invention pertains to the arts & crafts field of scrapbooking.

In the United States scrapbooking is considered the fastest growing hobby in America according to HIA (Hobby Industry Assoc.). Many hobbyist and non-hobbyist purchase article protectors for binders and albums. Americans purchase article protectors for hobbies and for business purposes. Despite this tremendous usage of article protectors, there continues to be a problem of inserting articles, pages, artwork, photos, and paper into these products. The completed work that is inserted into these article protectors is often bent, torn separated or gets stuck upon application. Applying article protectors without an inserting scrapbook page device is tedious and time consuming.

BRIEF SUMMARY OF THE INVENTION

The present invention comprises of a inserting article device, which will aide, protect and make easier the application of article protectors, sleeves, and view binders. It is a primary objective of this invention to provide a device, which overcomes the disadvantages as briefly, outlined above.

Accordingly, besides the objects and advantages of the inserting scrapbook page device described in my above patent, several objects and advantages of the present invention are:

(a) to provide an inserting device for an easier way of applying article protectors over articles art work, photo pages, and paper;

(b) to provide an inserting device which will prevent the sticking, bending of photos and articles into article protectors, which currently occurs;

(c) to provide an inserting device with a quick and time saving approach to the application of article protectors;

(d) to provide an inserting device which protects articles, pages, art work and photos, during application of article protectors;

(e) to provide an acid, PVC, and lignin free inserting scrapbook page device for hobbyist to use when scrapbooking with photo albums;

(f) to provide an inserting device for a jam free way of slipping articles, photos etc. into view binders;

(g) to provide an inserting device that ends the hassles of applying article protectors;

(h) to provide an inserting device which is light weight and easy for travel and packing;

(i) to provide an inserting device which speeds up the current time of applying article protectors;

(j) to provide an inserting device which is durable, that will not tear or crack;

(k) to provide an inserting device which is colorful and easy to see amongst other tools;

(l) to provide an inserting device which satisfies a need in completing pages of an album or binder.

REFERENCE NUMERALS IN DRAWINGS

| | |
|---|---|
| 10 inserting scrapbook page device | 12 spine, binding, and groove |
| 14 inside of inserting device | 16 article in a binder or album |
| 18 rings/hinges on a binder/album | 19 permanently closed side of a article protector |
| 20 article protector | 21 open end of article protector |
| 22 an article consisting of photos, die cuts, papers | 24 article loose, not in a binder |

DETAILED DESCRIPTION OF THE INVENTION

Figure 1:
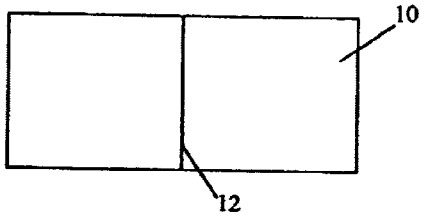
FIG. 1 is a perspective view of a open, lying flat "inserting article device".

The preferred embodiment of the inserting scrapbook page device of the present invention is best illustrated in FIG 1. The inserting scrapbook page device is made of a flat thin material, which can be repeatedly, folded on its spine without fracturing. In the preferred embodiment, the inserting scrapbook page device is a flexible plastic, such as high-density polyethylene available from Symplastics of St. Peters, Mo. In the preferred embodiment the inserting scrapbook page device is acid, lignin and PVC free.

Figure 2:
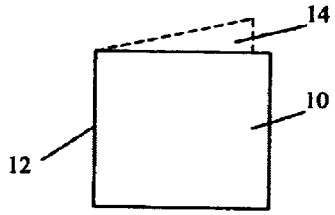
FIG. 2 is a perspective view of a folded semi closed "inserting article device".

As seen in FIG. 2, the inserting scrapbook page device is folded on the spine. The inserting scrapbook page device however, can consist of any other material that can be repeatedly folded, without fracturing. Such material as polyethleen, polypropylene, vinyl, nylon, rubber, leather, various impregnated or laminated fibrous materials, various plasticized materials, cardboard, and paper. The inserting scrapbook page device is typically a 0.015 inches thick but can be a higher or lower thickness. The inserting scrapbook page device is typically in a rectangular shape. The outer four comers is typically squared to cover the greatest area, but they can be beveled or rounded for appearance. A vertical groove in the center, of the inserting scrapbook page device is considered to be the spine. The spine, may be formed by machining, scoring, rolling or extruding. Extruding according to Webster means to push or thrust out, to shape with a die.

Figure 3:
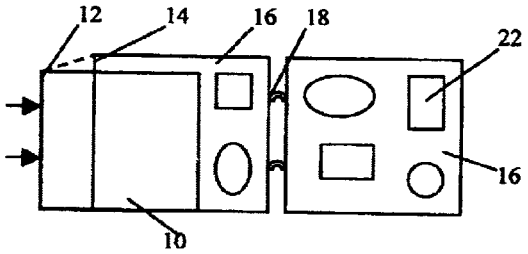
FIG. 3 is a perspective view of a "inserting article device" wrapping around and starting to cover a article in a binder or album.

The inserting scrapbook page device as illustrated in FIG. 3 is covering a page of artwork inside of a hinged or ringed binder or album.

Figure 4:
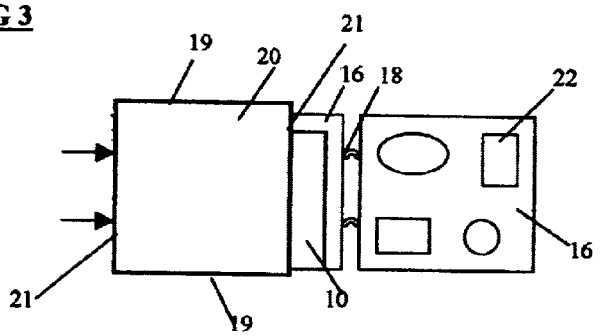
FIG. 4 is a perspective view of a "article protector" which has an opening on two ends and permanently closed on the other two ends; sliding around the "inserting article device", which is covering the articles.

In FIG. 4 the article protector, with two open ends is sliding around the inserting scrapbook page device which is covering the page of artwork. Suitable examples of article protectors, can be Creative Memories® portrait sleeve pages, page protectors, pages; West Trim™ page protectors; Hobby Lobby® page sleeves; Avery® sheet protector products, side insert protectors, top insert protectors, quick load protector and the like in various sizes and styles.

Figure 5:
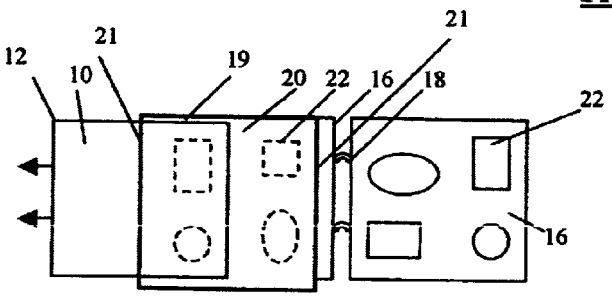
FIG. 5 is a perspective view of the "inserting article device" sliding out of the "article Protector; from the opposite open end; from which it entered, thereby leaving the article protector directly on top making the article visible.

In FIG. 5 the inserting scrapbook page device is being removed by sliding the inserting scrapbook page device out of the opposite open end, from which it originally entered in the article protector thus leaving behind the page of artwork. The page of artwork, is now visible and protected under the article protector in an album.

Figure 6:
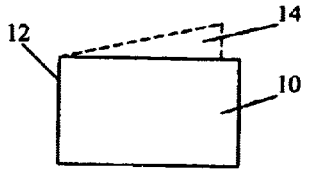
FIG. 6 is a perspective view of an elongated semi closed "inserting article device".
Figure 7:
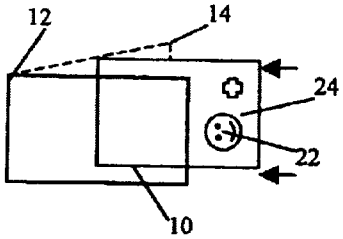
FIG. 7 is a perspective view of an elongated "inserting article device" with a article being inserted into the inserting scrapbook page device thereby eventually covering the article.

The following figures are similar to FIGS. 1–5 except the inserting scrapbook page device is elongated to show a different method of use while applying article protectors. As seen in FIG. 6, it is the same as FIG. 2 except it is elongated, to show a different method of use. The inserting scrapbook page device as illustrated in FIG. 7 is covering a article not in a binder.

Figure 8:
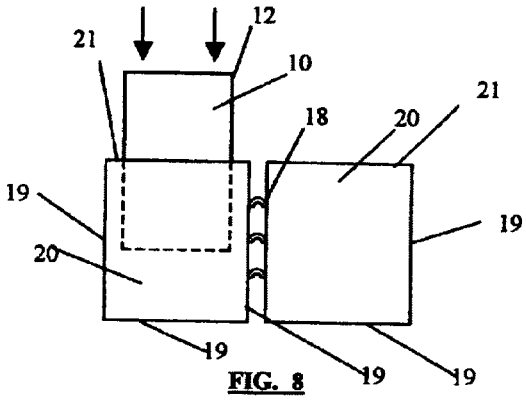
FIG. 8 is a perspective view of an "inserting article device" with articles inside, completely covered inside sliding down into a top loading article protector, which is permanently closed on three side and has only one opening at the top; and is in a binder.
Figure 9:
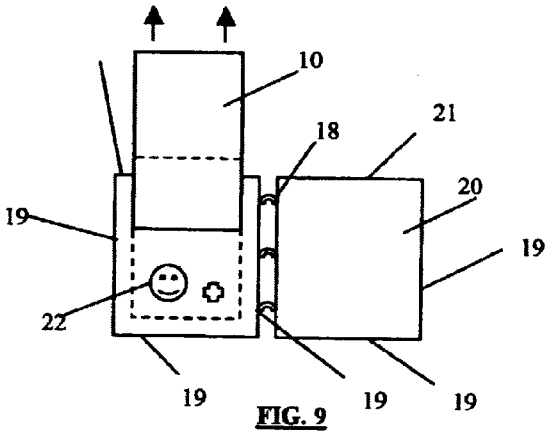
FIG. 9 is a perspective view of the "inserting article device" sliding out of the one opening at the top of the article protector, and leaving behind the articles inside of the article protector.

The inserting scrapbook page device in FIG. 8 has articles completely covered, and is sliding down into a top loading article protector which has only one opening and three permanently closed sides and is in a binder. In FIG. 9 the inserting scrapbook page device is being removed by sliding out of the top opening of the article protector thus leaving behind the article. The article is now visible and protected under the article protector.

Advantages

From the description above, a number of advantages of the inserting scrapbook page device become evident:

(a) a time saving advantage of using the inserting scrapbook page device can be seen.

(b) the inserting scrapbook page device ends the hassles of getting stuck while slipping article protectors, photo sleeves, onto articles which consists of photos, papers, die cuts.

(c) the use of the inserting scrapbook page device covers all sides of the article, or paper, which prevents sticking, bending or tearing articles.

(d) with the use of colored plastic, the inserting scrapbook page device is highly visible on an art table.

(e) the inserting scrapbook page device ends former ways of applying article protectors, thus satisfying a need.

(f) the inserting scrapbook page device is durable and flexible, will not crack, tear or fracture.

(g) for packing, the device is made of a lightweight flat material.

(h) the user will find enjoyment, once the method of application is seen.

(I) the inserting scrapbook page device is safe for articles due to the acid, lignin and PVC free material.

(J) the inserting scrapbook page device works with article protectors which have one or more openings.

(k) the inserting scrapbook page device can be repeatedly folded on the spine.

Operation—FIG. 3, FIG. 4, FIG. 5, FIG. 7, FIG. 8, FIG. 9

The manner of using the inserting scrapbook page device 10 as shown in FIG. 3 covering the article 22, inside 14 the inserting scrapbook page device 10 (FIG. 3). The spine 12 of the inserting scrapbook page device 10 is on the opposite side of the rings or hinges 18 as found on photo albums, or binders (FIG. 3).

As shown in FIG. 4 the inserting scrapbook page device 10 has a article 22 covered. The article protector 20 which is covering a article 22, slides around the inserting scrapbook page device 10, through one of it's two open ends 21.

In FIG. 5 the inserting scrapbook page device 10 is being pulled out of the article protector 20 on the opposite open end, by its spine thus making the article 16 visible through the article protector 20.

In FIG. 7 the inserting scrapbook page device 10 is covering a article 22. In FIG. 8, the inserting scrapbook page device 10 has covered a article 22 and is sliding down into a top loading article protector 20, which is located in a binder. Once the inserting scrapbook page device 10 is inserted into the article protector 20, its removed by holding the device 10 along the spine 12, from the same open end 21 as it entered into the article protector 20, thus leaving the article 22 visible through the article protector 20.

Conclusion

Accordingly, the reader will see this invention can be used to apply article protectors easily and conveniently over a scrapbook page. In addition this invention saves time by making the application of article protectors, less encumbering. Further more the device has additional advantages in that It provides the hobbyist a hassle free approach of applying article protectors;

It provides a saving of time over the current method;

It provides durability, that will not crack, tear or fracture;

Its permits the hobbyist to locate it quickly amongst other tools, due to its color;

It provides an easier method, which satisfies a need;

It provides protection of articles from getting stuck, or bent torn during application of article protectors.

It provides the artist with an acid, lignin and PVC free device.

It provides the artist with the ability to use different kinds of article protectors such as top loading, side loading and sleeves.

It provides the artist with the ability to use article protectors with one or more open ends.

Although the description above contains much specificity, these should not be construed as limiting the scope of the invention but merely providing illustrations of some of the presently preferred embodiments of this invention. For example the inserting scrapbook page device can have different, colors, materials, sizes, and spines. The spine can be replaced with a hinge that connects two otherwise unconnected halves, instead of one full piece together. The methods of use can vary with top load, side load article protectors. Thus the appended claims and their legal equivalents should determine the scope of the invention, rather then by the example given.

What I claim as my invention is:

1. A method of covering and protecting articles comprising the steps of:

(a) providing a protecting device having a planar shaped sheet member with a length, a width, and a vertical groove of sufficient size to substantially cover articles;

(b) take planar shaped sheet member and fold at said vertical groove to form a spine and two folded regions;

(c) open device and insert article between the two folded regions;

(d) close device;

(e) slide one open end of an article protector around said protecting device to substantially cover said protecting device and said inserted article, excluding the spine;

(f) hold article protector, and on opposite open end of article protector, pull protecting device out by the spine from between the article protector;

(g) thus leaving article substantially covered and protected by the article protector.

2. A method of covering and protecting pages of artwork comprising the steps of:

(a) providing a protecting device having a planar shaped sheet member with a length, a width, and a vertical groove of sufficient size to substantially cover a page of artwork;

(b) take planar shaped sheet member and fold at said vertical groove to form a spine and two folded regions;

(c) open device and insert page of artwork between the two folded regions;

(d) close device;

(e) slide one open end of an article protector around said protecting device to substantially cover said protecting device and said inserted page of artwork, excluding the spine;

(f) hold article protector, and on opposite open end of article protector, pull protecting device out by the spine from between the article protector;

(g) thus leaving page of artwork substantially covered and protected by the article protector.

* * * * *